US009138093B1

(12) United States Patent
Chou

(10) Patent No.: US 9,138,093 B1
(45) Date of Patent: Sep. 22, 2015

(54) ROLLER CURTAIN FIXING BRACKET FOR BOTH INNER AND OUTER WINDOWS

(71) Applicant: Tser Wen Chou, Taipei (TW)

(72) Inventor: Tser Wen Chou, Taipei (TW)

( * ) Notice: Subject to any disclaimer, the term of this patent is extended or adjusted under 35 U.S.C. 154(b) by 0 days.

(21) Appl. No.: 14/445,017

(22) Filed: Jul. 28, 2014

(51) Int. Cl.
*E06B 9/17* (2006.01)
*A47H 1/142* (2006.01)

(52) U.S. Cl.
CPC . *A47H 1/142* (2013.01); *E06B 9/17* (2013.01)

(58) Field of Classification Search
CPC ..... A47H 1/102; A47H 1/104; A47H 1/13; A47H 1/10; A47H 1/14; A47H 1/142; A47H 1/144; E06B 9/17
USPC ..... 248/252, 254, 262, 267, 268, 270, 271, 248/272; 160/368.1
See application file for complete search history.

(56) References Cited

U.S. PATENT DOCUMENTS

| | | | | | |
|---|---|---|---|---|---|
| 1,082,939 | A | * | 12/1913 | Flanagan | 248/271 |
| 1,525,895 | A | * | 2/1925 | Sherwood | 248/254 |
| 1,559,902 | A | * | 11/1925 | Miller | 248/270 |
| 1,564,328 | A | * | 12/1925 | Cutting | 160/112 |
| 2,521,062 | A | * | 9/1950 | Hott | 248/252 |
| 4,226,396 | A | * | 10/1980 | Bowers | 248/268 |
| 4,538,785 | A | * | 9/1985 | Damsgaard | 248/268 |
| 5,529,273 | A | * | 6/1996 | Benthin | 248/254 |
| 5,857,653 | A | * | 1/1999 | Dujlovich | 248/267 |

* cited by examiner

*Primary Examiner* — Christopher Garft
(74) *Attorney, Agent, or Firm* — Guice Patents PLLC

(57) ABSTRACT

A roller curtain fixing bracket for both inner and outer windows, which is composed of two identical components for more conveniently installing the entire roller curtain assembly on the wall faces of the inner and outer windows. The roller curtain fixing bracket includes a base seat, two connection boards integrally extending from two ends of the base seat in reverse directions, and two support boards connected with the connection boards to form a main structure of the fixing bracket. After the main structures of the fixing brackets are locked on the left and right corners of the window, one single roller curtain assembly or double roller curtain assemblies can be installed on the support boards to provide sunlight shading effect.

4 Claims, 12 Drawing Sheets

ROLLER CURTAIN FIXING BRACKET FOR BOTH INNER AND OUTER WINDOWS

BACKGROUND OF THE INVENTION

1. Field of the Invention

The present invention relates generally to a roller curtain fixing bracket, and more particularly to a roller curtain fixing bracket for both inner and outer windows. The roller curtain fixing bracket is composed of one single type of components so that the roller curtain can be more conveniently installed.

2. Description of the Related Art

A conventional roller curtain device generally includes a left fixing bracket and a right fixing bracket with different structures. The left and right fixing brackets are first locked on the wall and then the cooperative cord winder and the curtain sheet reel are mounted on the fixing brackets in front of the window to shade the sunlight. Different forms of windows have different window edge structures with different depth. Therefore, it is necessary to design different fixing brackets for fixing the roller curtain. The different specifications of different windows necessitate numerous components so that the cost is higher. Moreover, in installation, it is necessary to distinguish the left-side and right-side components from each other. As a result, it is time-consuming and complicated to assemble and install the roller curtain.

SUMMARY OF THE INVENTION

It is therefore a primary object of the present invention to provide a roller curtain fixing bracket for both inner and outer windows. The roller curtain fixing bracket includes: a base seat, which is a plane board structure, the plane board structure being formed with several slots, whereby screws can be screwed through the slots to lock the plane board structure on the wall face; two connection boards integrally extending from two ends of the base seat in reverse directions. Several hub sections are disposed on the two connection boards; and two support boards having the same structure for overlapping and connecting with the connection boards. Each support board includes a locking board, a locating board for connecting with the roller curtain components and an oblique board integrally connected with the locking board and the locating board. The locating board is formed with several rectangular slots and a hub section. The main structures of the fixing brackets are identical to each other, whereby in installation, it is unnecessary to distinguish the left-side and right-side components from each other. Therefore, the fixing brackets can be quickly installed on the corners and the wall faces of the window for more efficiently installing the roller curtain.

The present invention can be best understood through the following description and accompanying drawings, wherein:

DETAILED DESCRIPTION OF THE PREFERRED EMBODIMENTS

Figure 1:
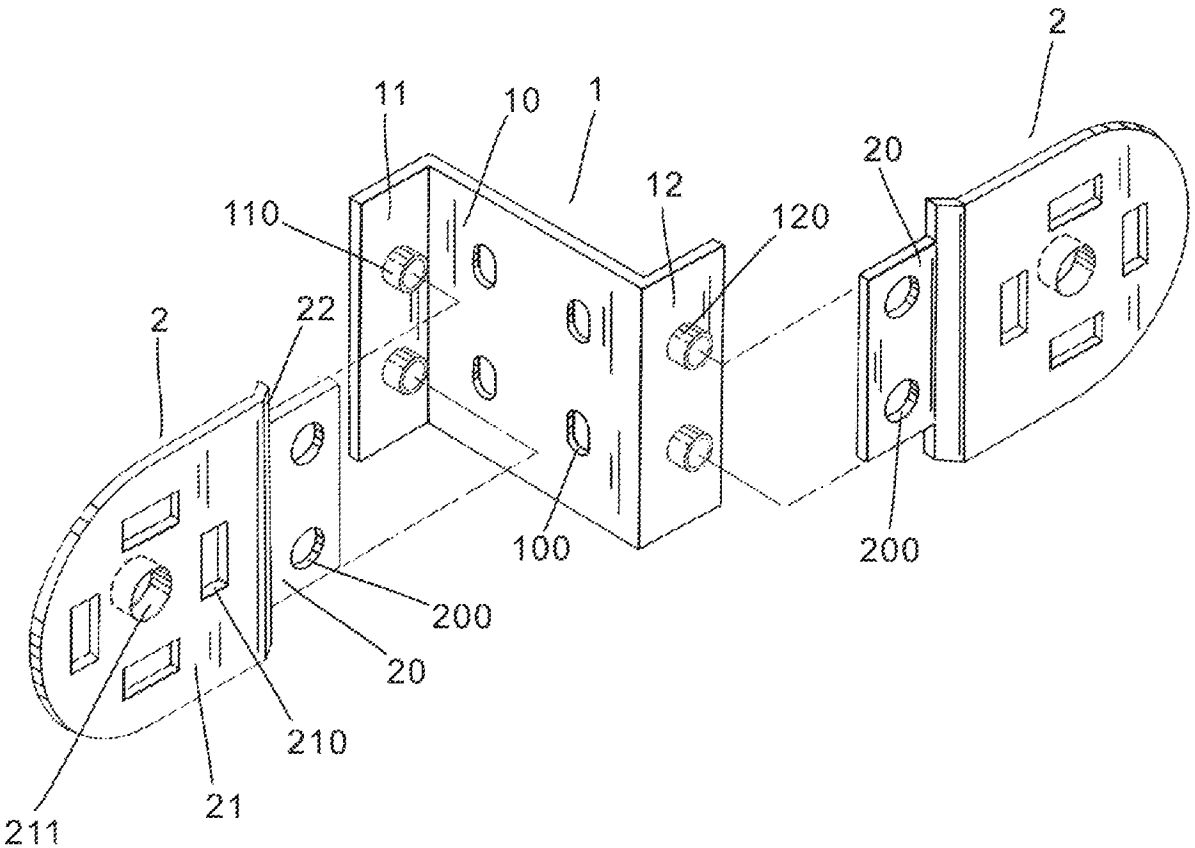
FIG. 1 is a perspective exploded view of the left fixing bracket of the present invention.

Please refer to FIG. 1, which is a perspective exploded view of a first embodiment of the roller curtain fixing bracket of the present invention. According to the first embodiment, the roller curtain fixing bracket of the present invention includes a base seat 1 and two support boards 2. The base seat 1 has a plane board 10 formed with several slots 100. The base seat 1 further has two connection boards 11, 12 integrally extending from two ends of the plane board 10 in reverse directions. Several hub sections 110, 120 are disposed on the two connection boards 11, 12 and protrude from the connection boards 11, 12 in the same direction. The support boards 2 are connected to the hub sections 110. Each support board 2 includes a locking board 20, a locating board 21 for connecting with roller curtain components and an oblique board 22. The locking board 20 is formed with perforations 200 for correspondingly fitting with the hub sections 110 of the connection board 11. The locating board 21 is formed with a hub section 211 and several rectangular slots 210 in which the roller curtain components are fitted and fixed.

Figure 2:
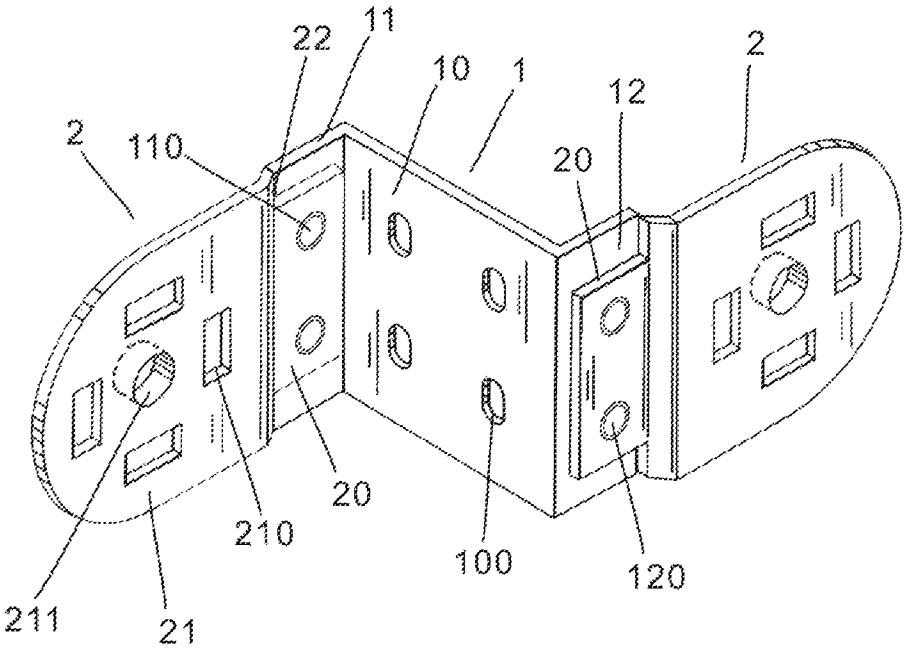
FIG. 2 is a perspective assembled view of the left fixing bracket of the present invention.

As shown in FIG. 2, when assembled, the perforations 200 of the locking board 20 are directly fitted onto the hub sections 110 of the connection board 11 to connect the support board 2 and the connection board 11 with each other. Then the front ends of the hub sections 110 are pressed and expanded to fix the support board 2. With respect to the connection board 12 on the other side of the base seat 1, the support board 2 can be turned by an angle to also fit the perforations 200 of the locking board 20 onto the hub sections 120 of the connection board 12 to connect the support board 2 and the connection board 12 of the base seat 1 with each other. Accordingly, the two support boards 2 are connected with the base seat 1 to form the main structure of the roller curtain fixing bracket of the present invention.

Figure 3:
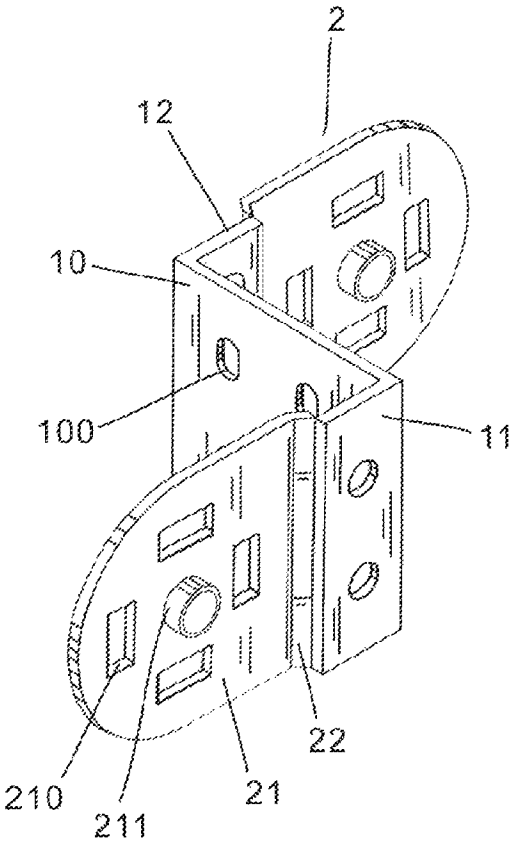
FIG. 3 is a perspective assembled view of the right fixing bracket of the present invention.

Please now refer to FIG. 3 in which the left fixing bracket of FIG. 2 is turned to a specific angular position to show the fixing bracket on the other side. Accordingly, the fixing bracket can be mounted on the right wall corner of the window.

Figure 4:
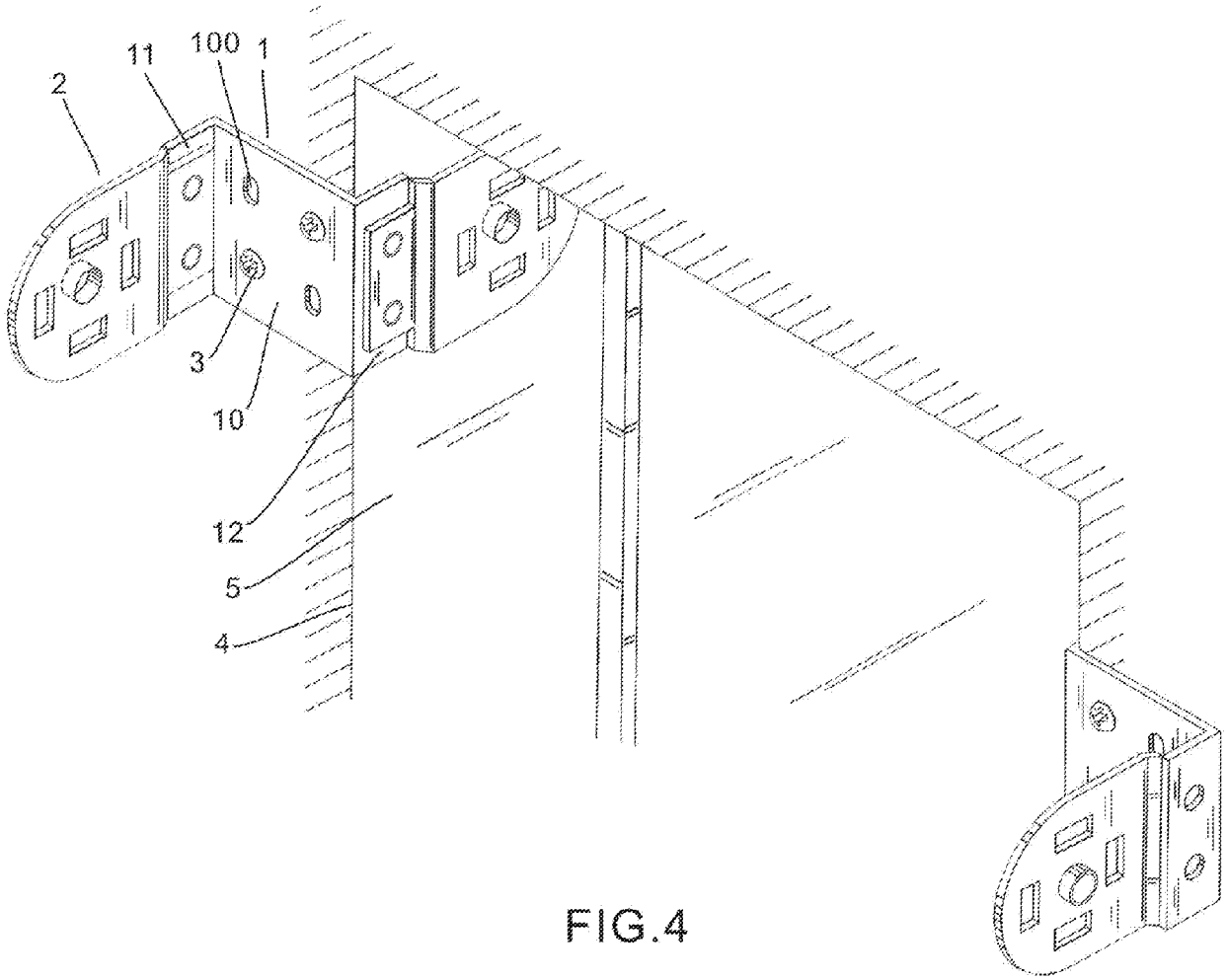
FIG. 4 is a perspective view showing the installation of the present invention.

Please refer to FIG. 4, which shows the installation of the fixing bracket of the present invention. The right-angle structure formed of the plane board 10 and the connection board 12 of the base seat 1 is attached to the wall corner 4. Then fixing screws 3 are screwed through the slots 100 of the plane board 10 into the wall 5, whereby one of the two support boards 2 is positioned on inner wall of the window, while the other of the two support boards 2 outward protrudes from outer wall of the window. Due to the oblique board 22, the support boards 2 are spaced from the wall 5 by a certain distance to facilitate sequential installation of the components of two roller curtains or one single roller curtain.

Figure 5:
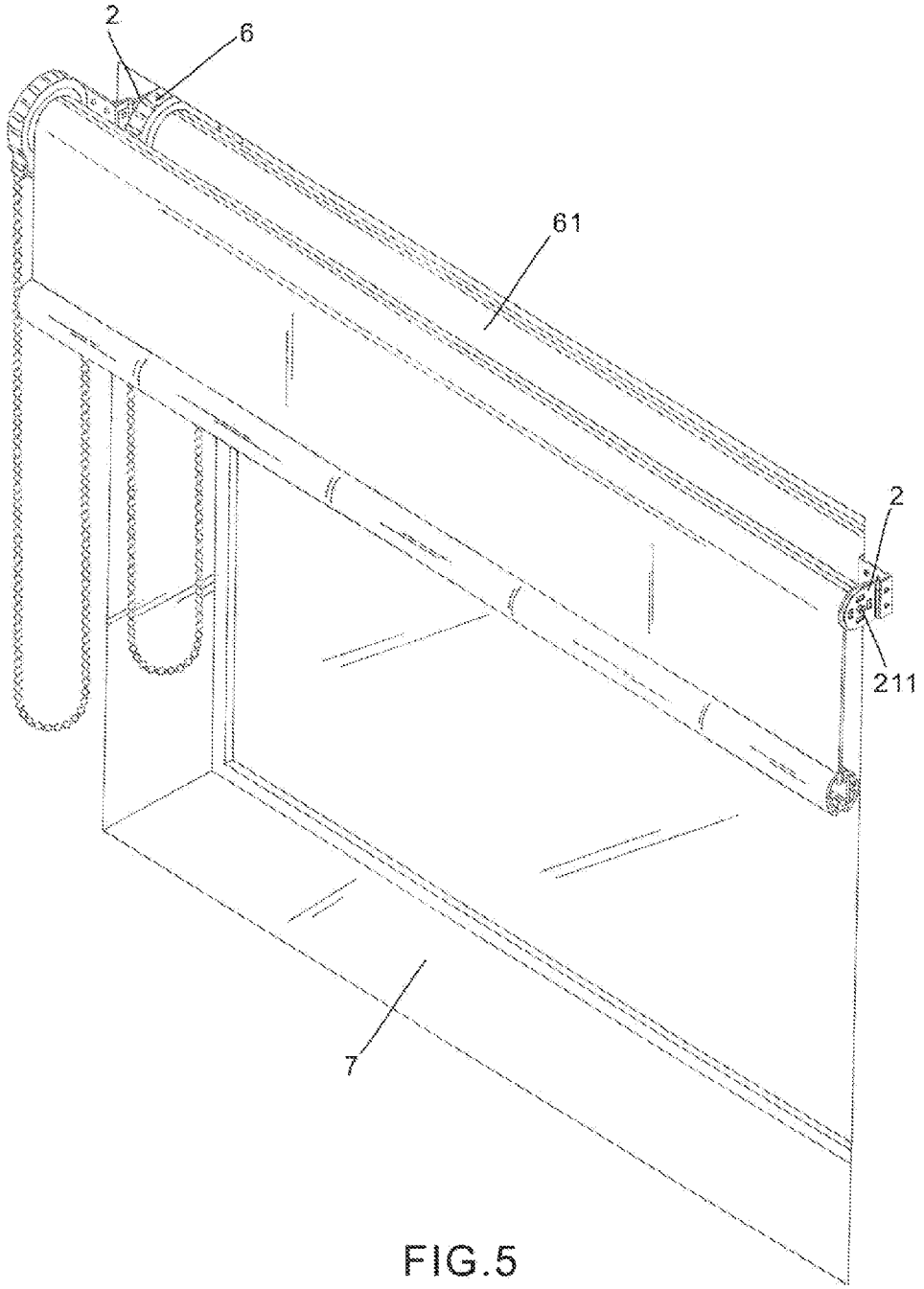
FIG. 5 is a perspective view showing the installation of double roller curtains of the present invention.
Figure 6:
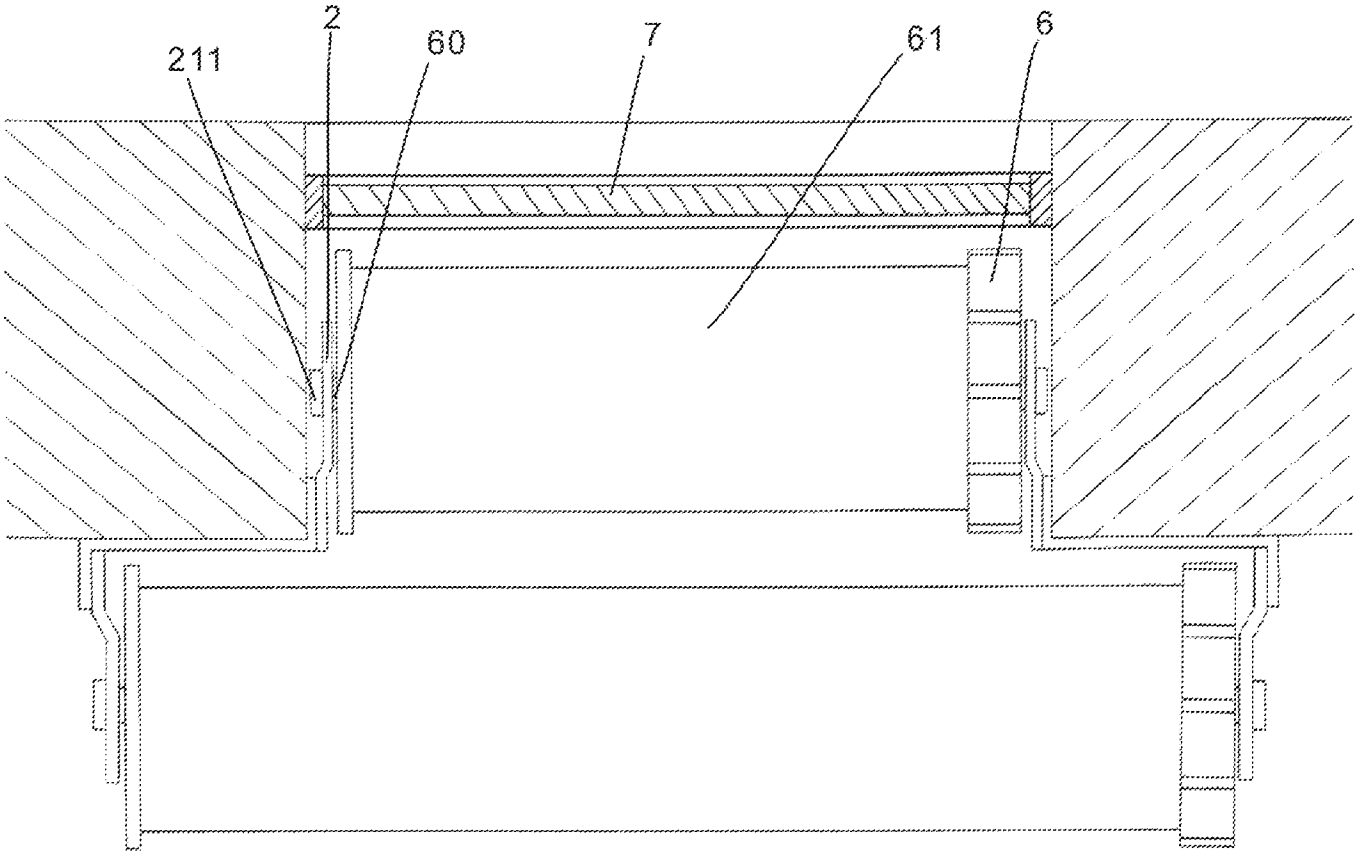
FIG. 6 is a top view showing the installation of double roller curtains of the present invention.

Please now refer to FIGS. 5 and 6, which show the installation of the roller curtain of the present invention. After the main structures of the two fixing brackets are respectively locked on the left and right walls, a cord winder 6 of the roller curtain is first fixed on the support board 2. A boss 60 of the other end is then inserted into the hub section 211 of the support board 2 on the other side, whereby two ends are fixed on the fixing brackets. Under such circumstance, the entire set of roller curtain sheet 61 can be installed in front of the window glass 7 to shade the sunlight.

Figure 7:
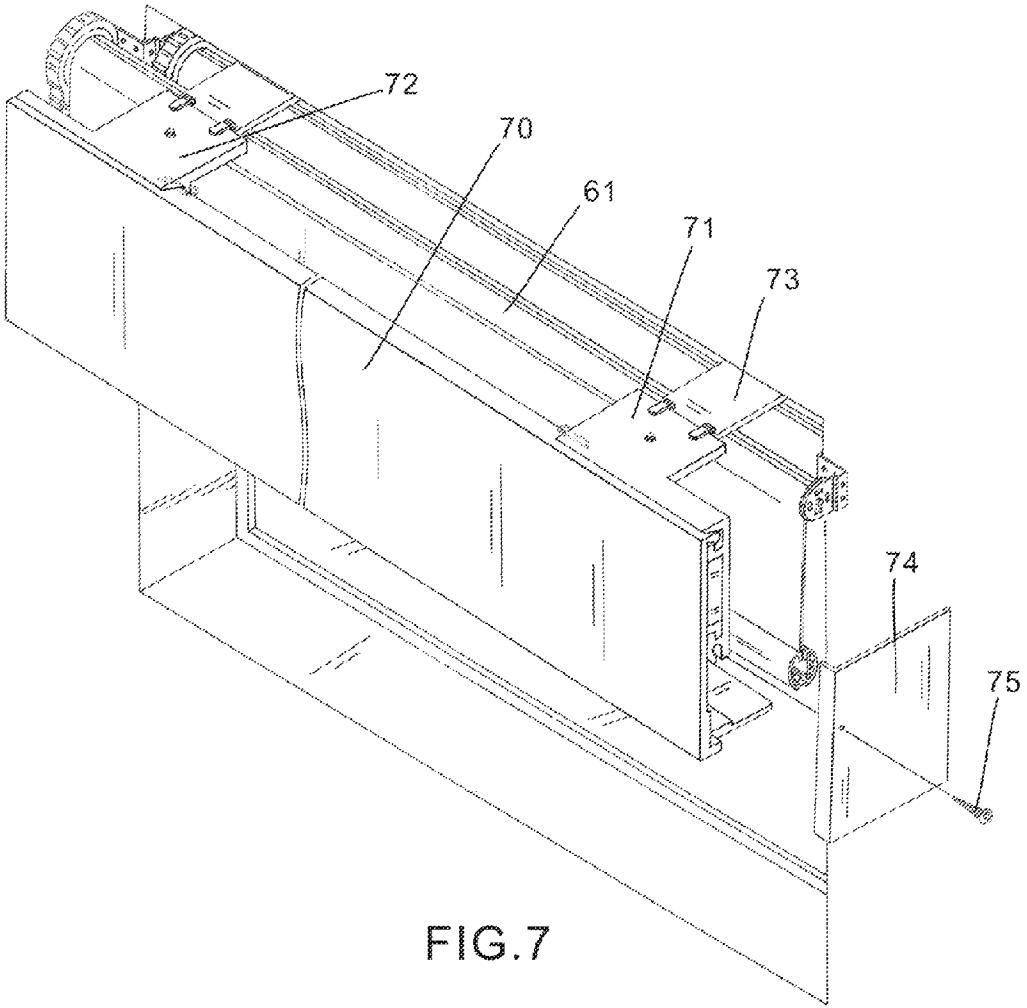
FIG. 7 is a perspective view showing that the roller curtain is concealed behind the decoration board.

Moreover, in order to beautify the appearance of the roller curtain, as shown in FIG. 7, after the entire set of roller curtain is completely installed, a decoration board 70 is additionally mounted on outer side of the roller curtain. Two sides of the decoration board 70 are latched and connected with two connection boards 71, 72. The rear ends of the connection boards 71, 72 are further connected to fixing plates 73 by means of screws. Then, via the fixing plates 73, the decoration board 70 is fixed on an upper wall face of the window and right positioned on outer side of the roller curtain to conceal the roller curtain sheet 61. The open spaces at two ends are blocked with cover bodies 74, which are locked by screws 75. Accordingly, a decoration form is completed.

Figure 8:
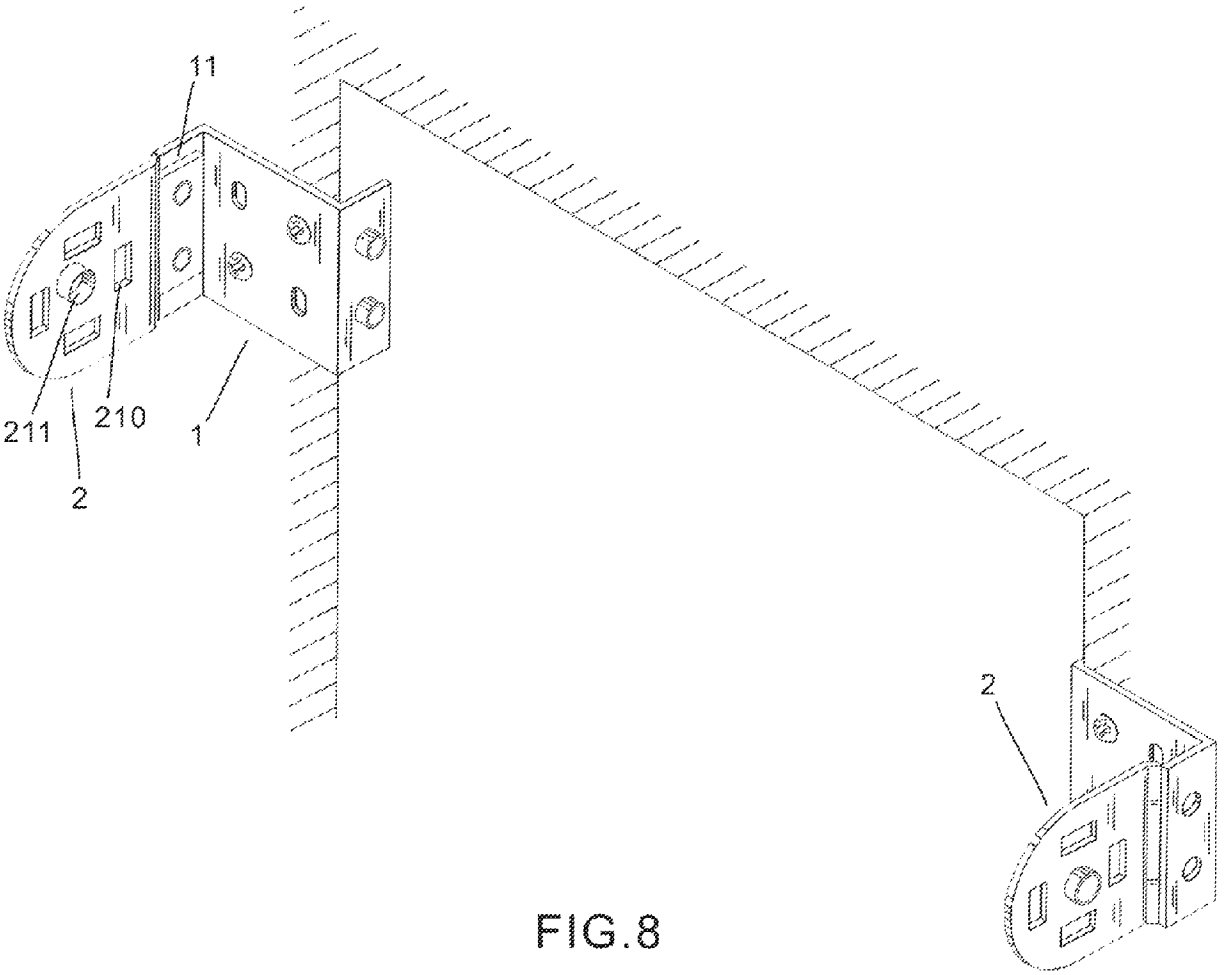
FIG. 8 is a perspective view showing another embodiment of the fixing bracket of the present invention.
Figure 9:
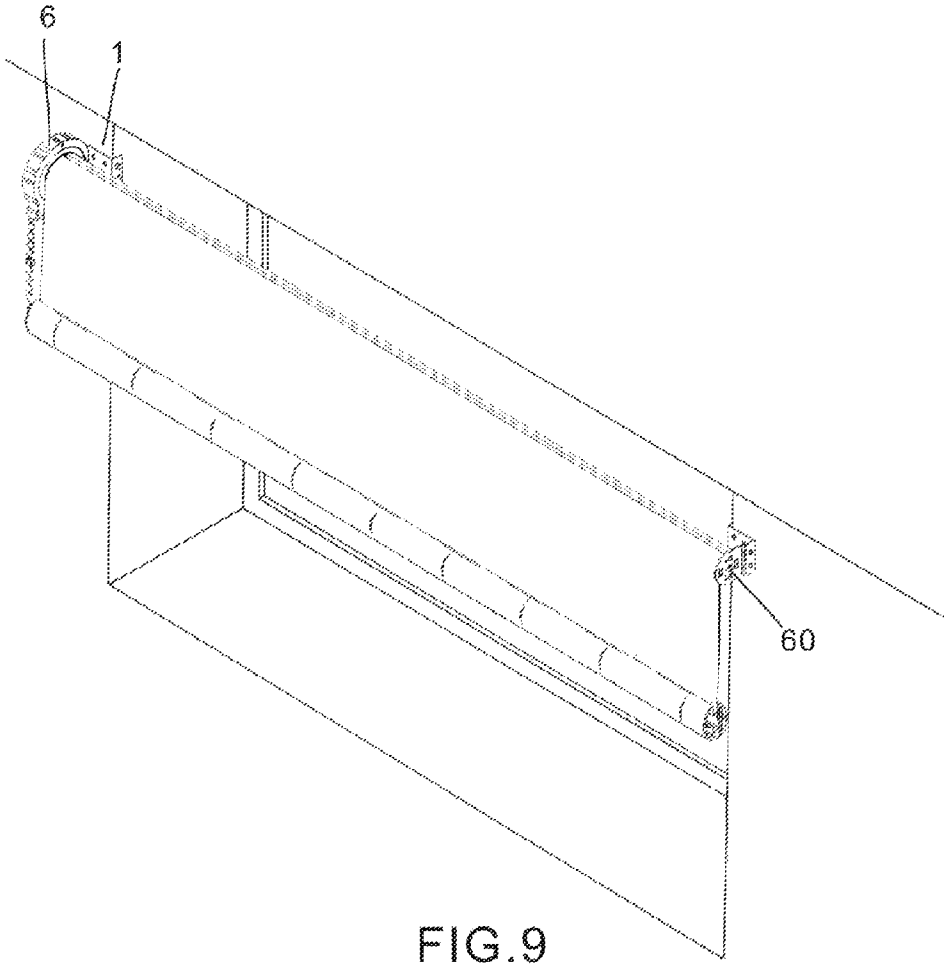
FIG. 9 is a perspective view showing the application of the other embodiment of the fixing bracket of the present invention.
Figure 10:
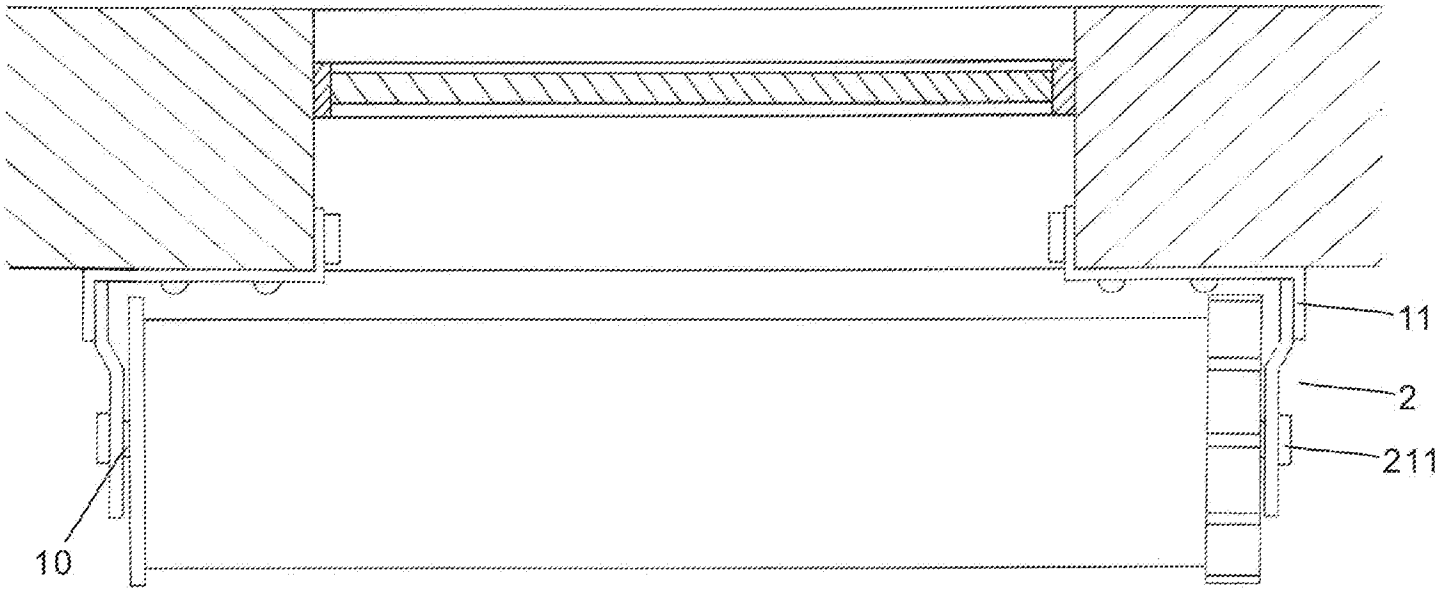
FIG. 10 is a top view of the other embodiment of the fixing bracket of the present invention.

Please now refer to FIGS. 8 to 10, which show that the present invention is applied to one single roller curtain for installing the same. In this embodiment, only one support board 2 is fixed on the connection board 11 of the base seat 1. Via the rectangular slots 210 and the hub sections 211 of the support board 2, the cord winder 6 and the boss 60 of the roller curtain are respectively fixedly connected with the support boards 2 on two sides. In this case, one single roller curtain assembly is completely installed (as shown in FIGS. 9 and 10).

Figure 11:
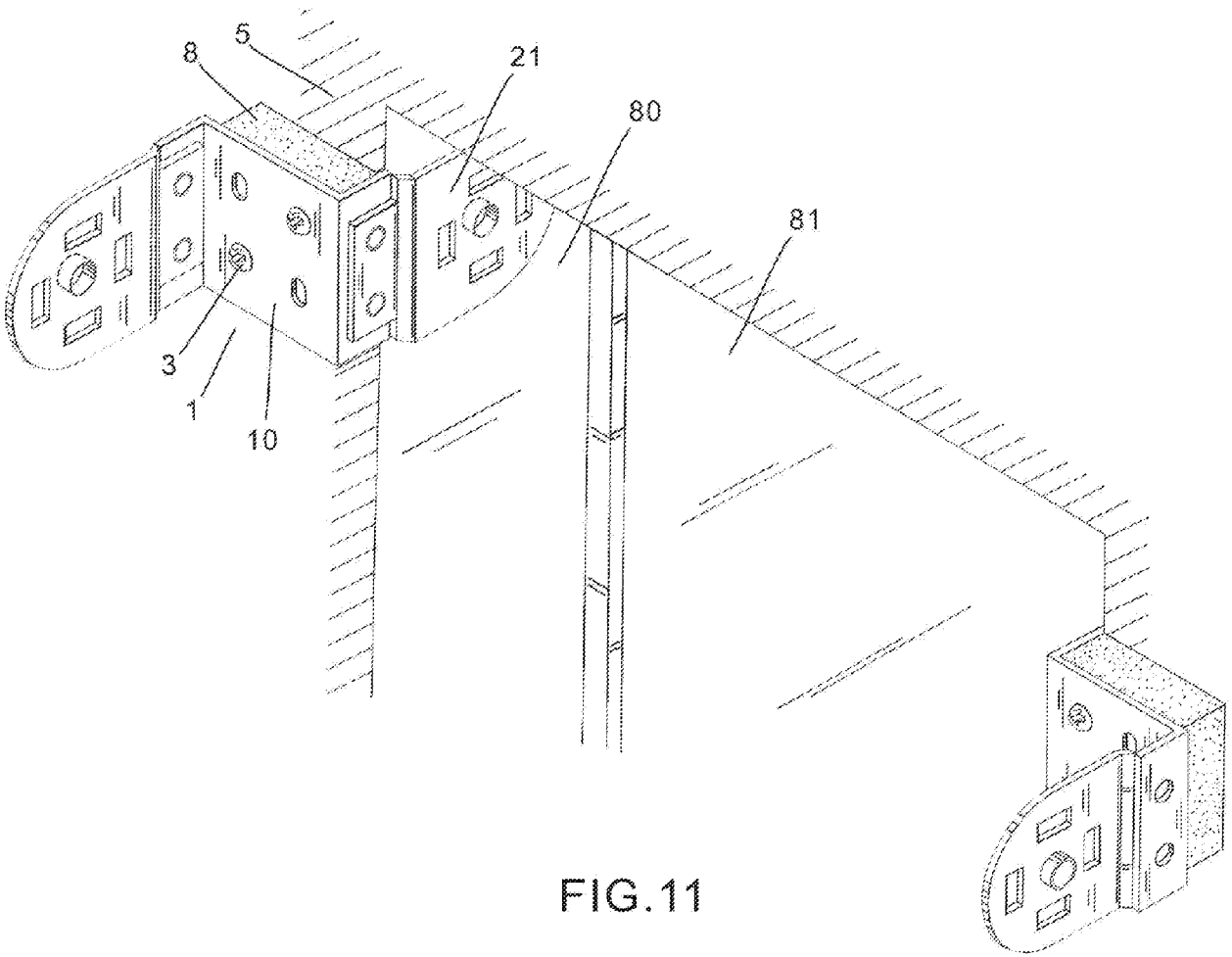
FIG. 11 is a perspective view showing still another embodiment of the fixing bracket of the present invention.
Figure 12:
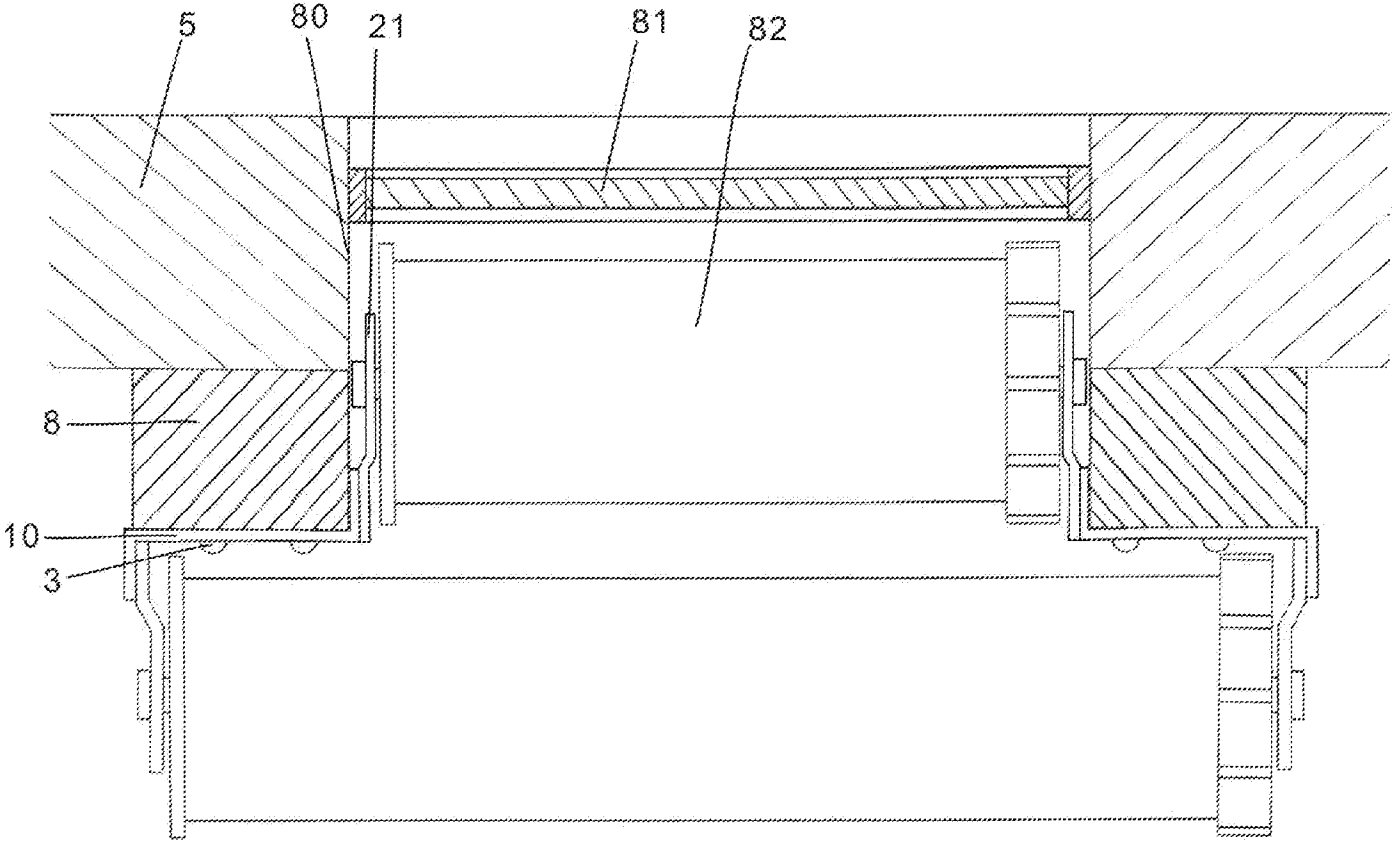
FIG. 12 is a top view of the other embodiment of the fixing bracket of the present invention according to FIG. 11.

Please now refer to FIGS. 11 and 12, which show that the present invention is applied to a narrow wall face of the widow edge. In this embodiment, a pad block 8 is fixedly disposed on rear face of the plane board 10 of the base seat 1. The pad block 8 can be made of plastic material or metal material. In installation, the pad block 8 is attached to the wall 5. Fixing screws 3 are screwed through the pad blocks 8 into the wall 5 to fixedly lock the entire set of fixing bracket on the wall 5. The main structure of the fixing bracket is padded with the pad blocks 8 to protrude forward. In this case, the support boards 2, which are originally impossible to be installed on the window edge due to excessive length, can be mounted on the wall face 80 of the window edge (as shown in FIG. 11). Accordingly, the roller curtain assembly 82 can be conveniently installed on a narrow window edge for shading the sunlight through the window 81. Therefore, the application range of the fixing bracket is widened (as shown in FIG. 12).

The above embodiments are only used to illustrate the present invention, not intended to limit the scope thereof. Many modifications of the above embodiments can be made without departing from the spirit of the present invention.

What is claimed is:

1. A roller curtain fixing bracket for both inner and outer windows, the roller curtain fixing bracket being installed on a corner of the inner and outer windows, the roller curtain fixing bracket comprising:

a base seat, which is a plane board structure, the plane board structure being formed with several threaded holes, whereby screws can be screwed into the threaded holes to lock the plane board structure on a wall face;

two connection boards perpendicularly extending from two ends of the base seat in reverse directions, several hub sections being disposed on the two connection boards; and two support boards having the same structure, each support board including a locking board, a locating board and an oblique board integrally connected with the locking board and the locating board, the locking board being formed with perforations, the number of the perforations being equal to that of the hub sections, the locating board being formed with a hub section and several rectangular slots in which roller curtain components are fixedly fitted, whereby the base seat, the connection boards and the support boards together form a main structure of the roller curtain fixing bracket for both inner and outer windows, the roller curtain fixing bracket being respectively fixedly installed on left and right corners of the window for installing one single roller curtain or double roller curtains.

2. The roller curtain fixing bracket for both inner and outer windows as claimed in claim 1, wherein the threaded holes of the plane board of the base seat are slots.

3. The roller curtain fixing bracket for both inner and outer windows as claimed in claim 1, wherein the base seat and the connection board contain an angle of 90 degrees.

4. The roller curtain fixing bracket for both inner and outer windows as claimed in claim 1, wherein the hub section of the support board is in the form of insertion boss.

* * * * *